US007367092B1

(12) United States Patent
Dilday

(10) Patent No.: US 7,367,092 B1
(45) Date of Patent: May 6, 2008

(54) CHILD-PROOF LOCK ASSEMBLY

(76) Inventor: Marlene A. Dilday, 103 Beechwood Rd., Ahoskie, NC (US) 27910

( * ) Notice: Subject to any disclaimer, the term of this patent is extended or adjusted under 35 U.S.C. 154(b) by 0 days.

(21) Appl. No.: 11/344,675

(22) Filed: Feb. 2, 2006

(51) Int. Cl.
*A44B 11/25* (2006.01)

(52) U.S. Cl. ..... 24/615; 24/587.12; 24/DIG. 38

(58) Field of Classification Search ..... 24/614, 24/615, 170, 188, 312, 313, 587.12, DIG. 38, 24/DIG. 42; 297/483, 484; 280/808
See application file for complete search history.

(56) References Cited

U.S. PATENT DOCUMENTS 5,125,718 A * 6/1992 Czernakowski et al. .... 297/484
5,380,067 A 1/1995 Turvill et al.
5,549,356 A 8/1996 Gray
5,683,138 A 11/1997 Ward, Jr. et al.
D389,426 S 1/1998 Merrick et al.
5,902,016 A 5/1999 Moran et al.
6,045,184 A 4/2000 Nakagama
6,073,317 A * 6/2000 Barison ..... 24/115 F
6,826,806 B2 * 12/2004 Eaton et al. ..... 24/115 F

FOREIGN PATENT DOCUMENTS

WO WO 9321044 A1 * 10/1993

* cited by examiner

*Primary Examiner*—James R Brittain

(57) ABSTRACT

A lock and harness assembly includes first and second locks removably attached to each other. The locks are coextensively shaped, and are independently and simultaneously pivotal between folded and unfolded positions. Each lock has a linear medial edge conjoined to the other's medial edge when the locks are at a locked position. First and second harnesses traverse through the first and second locks. The harnesses are slidably positioned through the locks. Each lock includes a mechanism for statically holding the harnesses at a locked position such that the harnesses are prohibited from sliding through the locks after the locks have been coupled. Each lock includes a mechanism for releasably coupling the locks to each other such that the locks must be slidably adapted along a linear path defined orthogonal to the harnesses.

18 Claims, 5 Drawing Sheets

CHILD-PROOF LOCK ASSEMBLY

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to lock assemblies and, more particularly, to a child-proof lock assembly for a child vehicle car seat.

2. Prior Art

It is well-known that many standard vehicle restraint systems do not adequately protect children from injury during vehicle collisions. For example, shoulder seat belts often do not adjust sufficiently to accommodate a child, sometimes resulting in the shoulder seat belt being dangerously positioned at the child's neck. To remedy this problem, supplemental child vehicle restraints, such as child car seats, have become an increasingly popular way of properly restraining children during vehicle collisions, thereby reducing injuries resulting therefrom. Instead of the conventional shoulder seat belt restraint, car seats usually employ some form of harness that extends across the entire torso of the child.

Most car seats with three- or five-point safety harnesses include a one- or two-piece sliding clip that is intended to hold the two shoulder straps in place over the child's shoulders. The two straps are generally threaded through the plastic clip, which should rest on the child's chest at approximately armpit-level. Unfortunately, because the clip slides easily to adjust to the size of the child, an active toddler may soon discover that he or she can slide the clip down, slip the harness straps from his or her shoulders, and climb out of the car seat.

Accordingly, a need remains for a child-proof lock assembly in order to overcome the above-noted shortcomings. The present invention satisfies such a need by providing a harness lock assembly that easy to use, provides peace of mind to drivers, and greatly increases the safety achieved for a toddler placed in the car seat. Such a child-proof lock assembly keeps a child safely restrained and allows the motorist to concentrate on driving the vehicle. The lock assembly also helps parents avoid expensive tickets for improperly restraining their children, and ultimately saves lives by effectively restraining infants and toddlers in the event of an accident.

BRIEF SUMMARY OF THE INVENTION

In view of the foregoing background, it is therefore an object of the present invention to provide a child-proof lock assembly. These and other objects, features, and advantages of the invention are provided by a combined child-proof lock and harness assembly for a child vehicle car seat.

The lock and harness assembly includes first and second locks removably attached directly to each other. Such first and second locks are coextensively shaped. The first and second locks are also independently and simultaneously pivotal between folded and unfolded positions. Each of the first and second locks has a linear medial edge directly conjoined to each other when the first and second locks are coupled at a locked position.

Each of the first and second locks preferably includes a base section that has planar top and bottom surfaces. A top flap is pivotally connected directly to a laterally disposed edge of the base section such that the top flap effectively articulates along a fulcrum axis registered parallel to the longitudinal length of the first and second harnesses. Each of the base sections preferably further includes a clasp for effectively receiving the lateral edge of each of the top flaps so that the top flaps and the base sections remain at the folded position during locked modes.

First and second harnesses traverse through the first and second locks such that the first and second harnesses effectively remain spaced apart when the first and second locks are attached to each other. Such first and second harnesses are slidably positioned through the first and second locks. The first and second harnesses are intercalated between the base sections and the top flaps respectively.

Each of the first and second locks includes a mechanism for statically holding the first and second harnesses at a locked position such that the first and second harnesses are advantageously and effectively prohibited from sliding through the first and second locks after the first and second locks have been attached to each other. Such a first and second harness holding mechanism preferably includes a plurality of coextensively shaped rigid pins that are equidistantly spaced along opposed edges of each of the base sections respectively. The pins extend upwardly from the top surfaces of the base sections and are oriented orthogonal thereto. Each of the first and second harnesses has flexible faces directly mateable with associated ones of the pins such that the pins firmly engage the first and second harnesses when the first and second locks are pivoted to a folded position.

Each of the first and second locks further includes a mechanism for releasably coupling the first and second locks directly to each other such that the first and second locks must be slidably adapted along a linear path defined orthogonal to the first and second harnesses respectively. Such a releasably coupling mechanism may include a pair of rectilinear arms that protrude outwardly from the linear medial edges of each of the base sections respectively. Each of the rectilinear arms has a flanged distal end provided with a laterally offset shoulder.

Each of the base sections includes a plurality of cavities formed in the linear medial edges thereof and each further includes a plurality of window openings formed in the bottom surfaces respectively. The arms are telescopically inserted through the cavities and along a linear path defined orthogonal to the longitudinal lengths of the first and second harnesses wherein the flanged distal ends of the arms become seated within the window openings when the first and second locks are fully engaged to the locked position. The flanged distal ends of the arms may be visible from the bottom surface of the base sections and are resiliently adaptable towards the top surfaces of the base sections respectively for effectively releasing the arms from the cavities and thereby unlocking the first and second locks. The top flaps are pivotal to an unfolded position while the arms are nested within the cavities.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
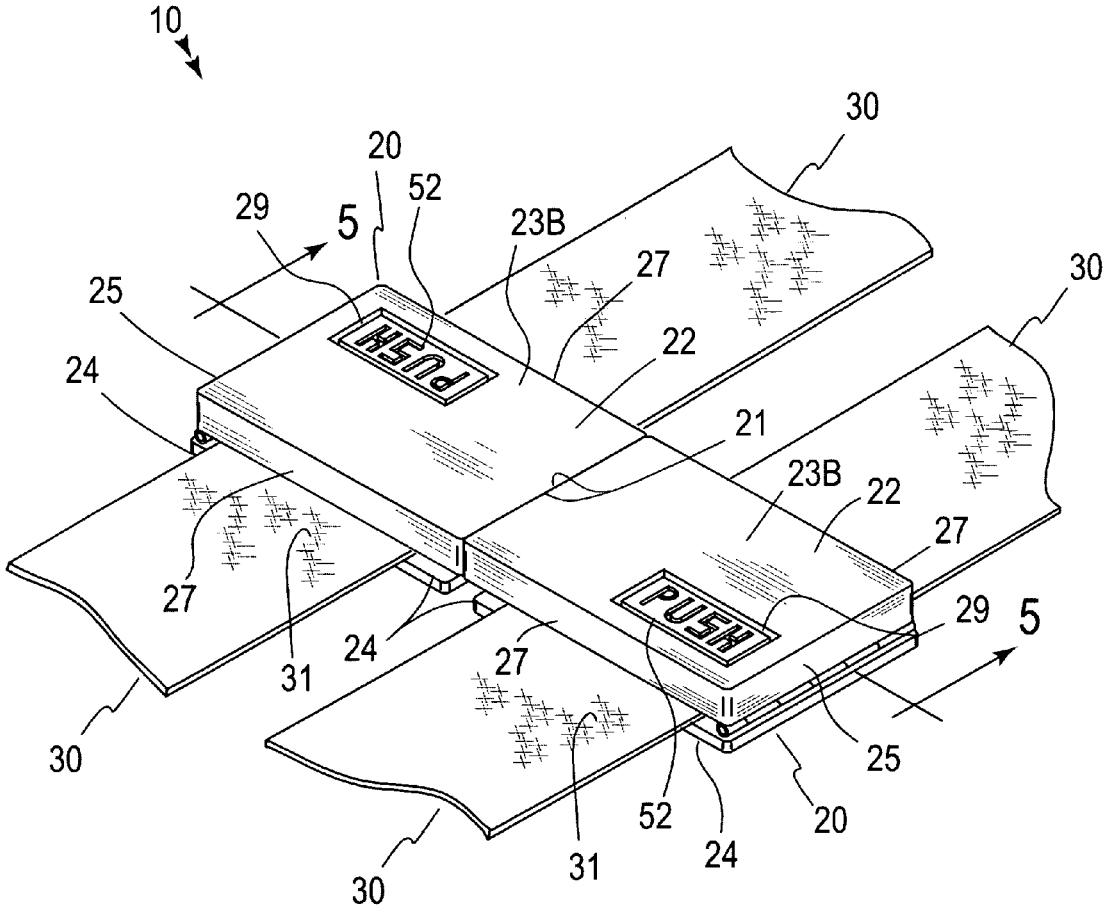
FIG. 1 is a perspective view showing a child-proof lock assembly, in accordance with the present invention.
Figure 2:
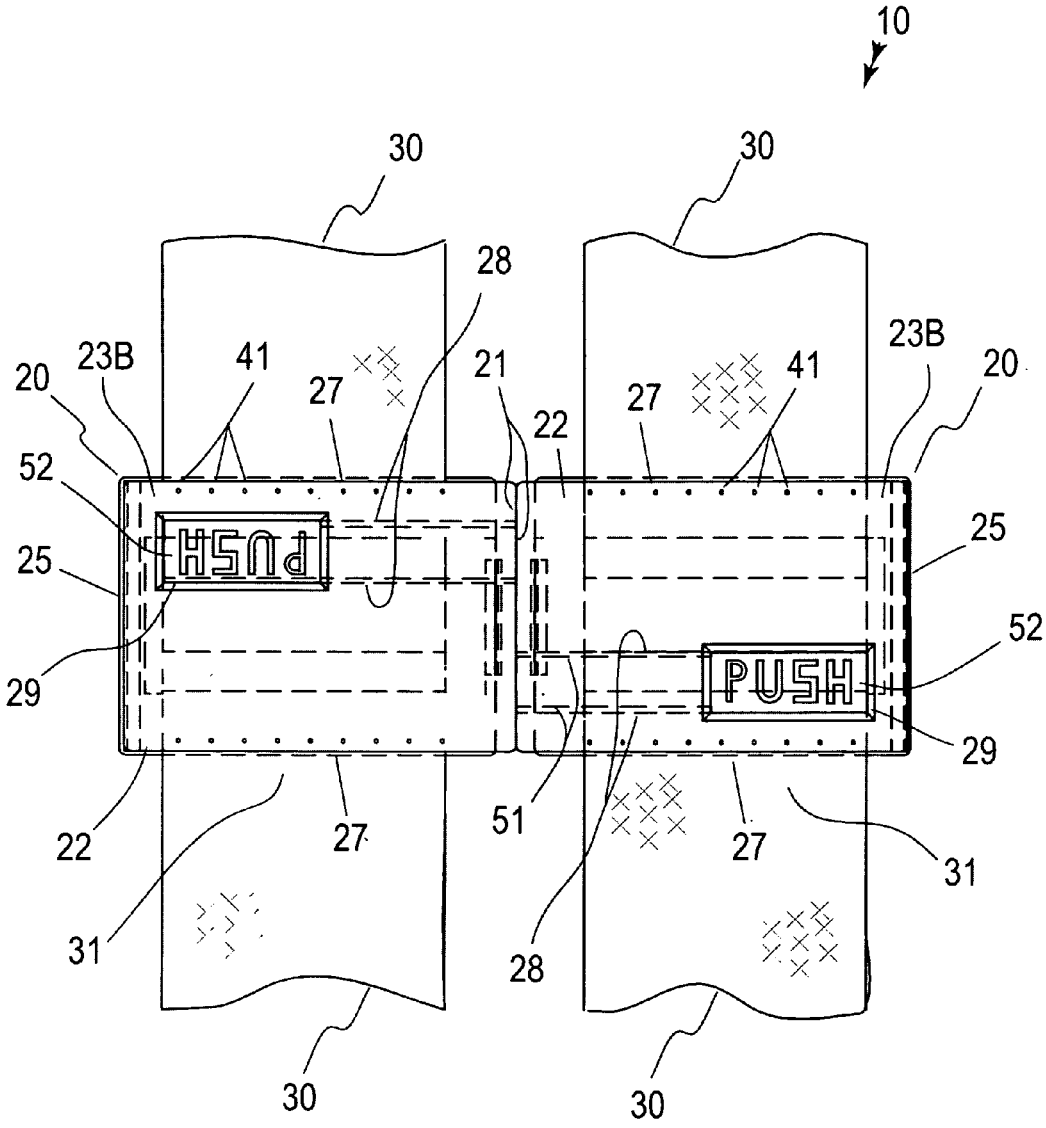
FIG. 2 is a top plan view of the assembly shown in FIG. 1, showing the first and second locks at a locked state.
Figure 3:
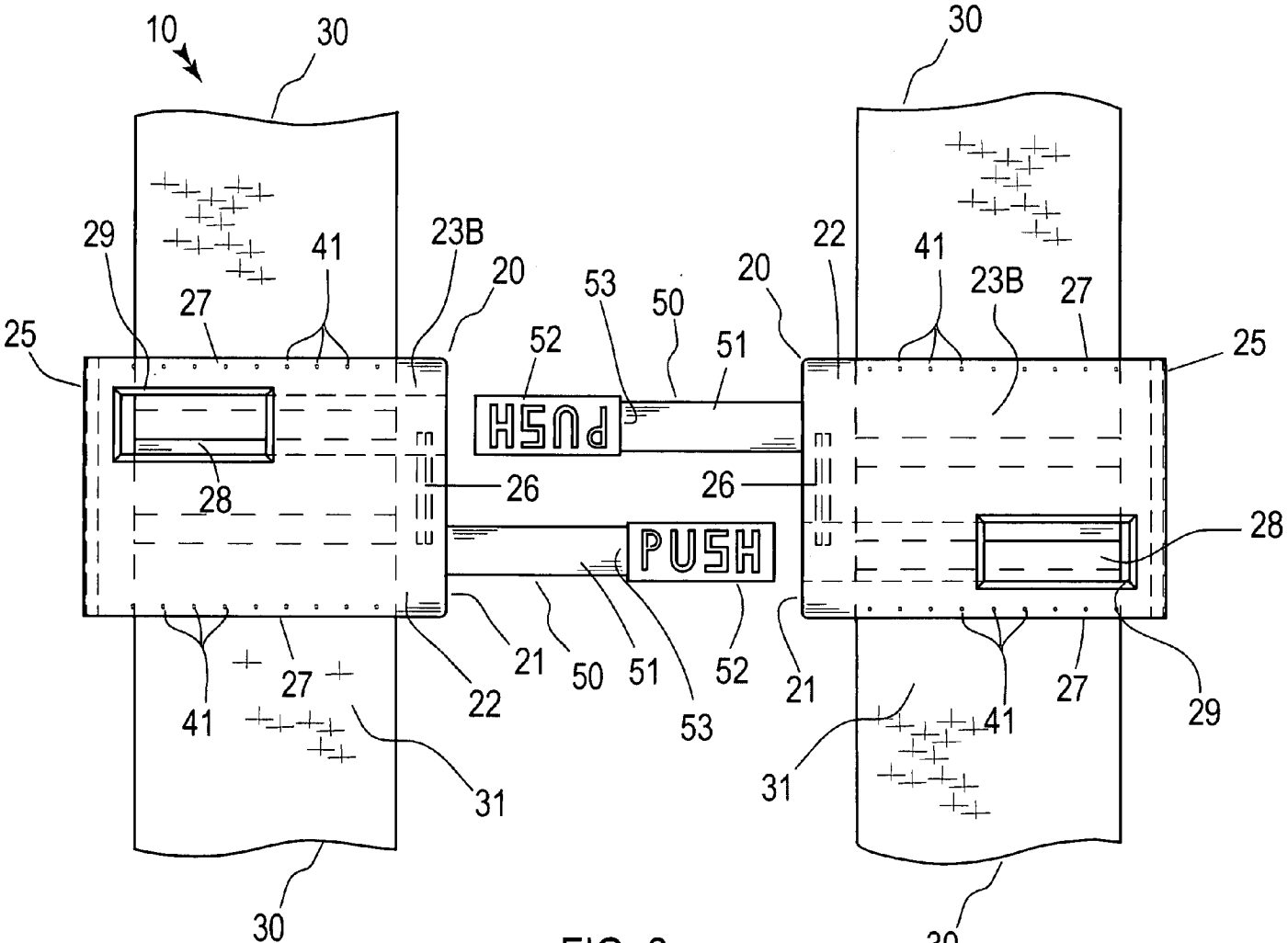
FIG. 3 is a top plan view of the assembly shown in FIG. 1, showing the first and second locks at an unlocked state.
Figure 4:
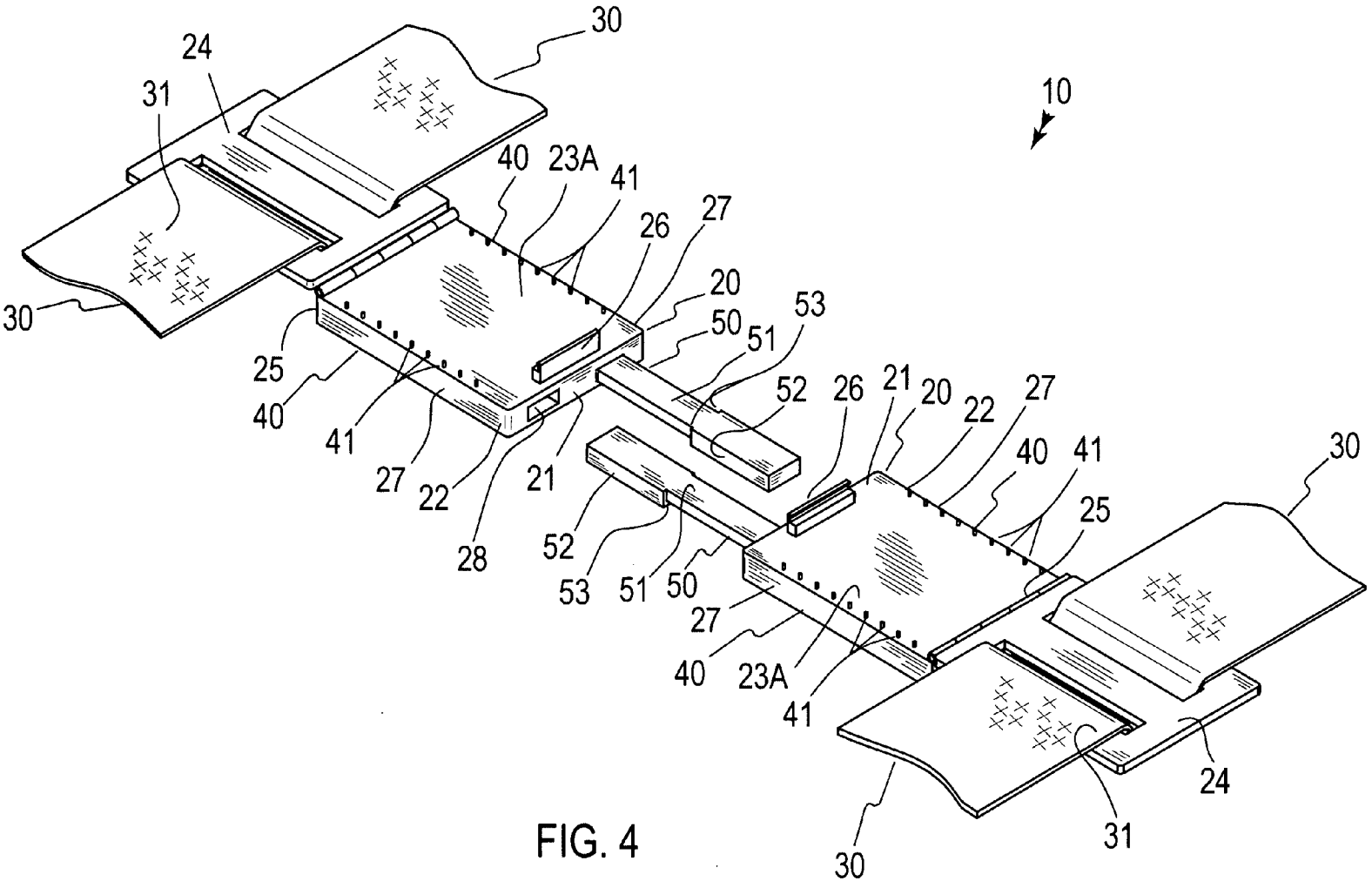
FIG. 4 is a bottom perspective view of the assembly shown in FIG. 3.
Figure 5:
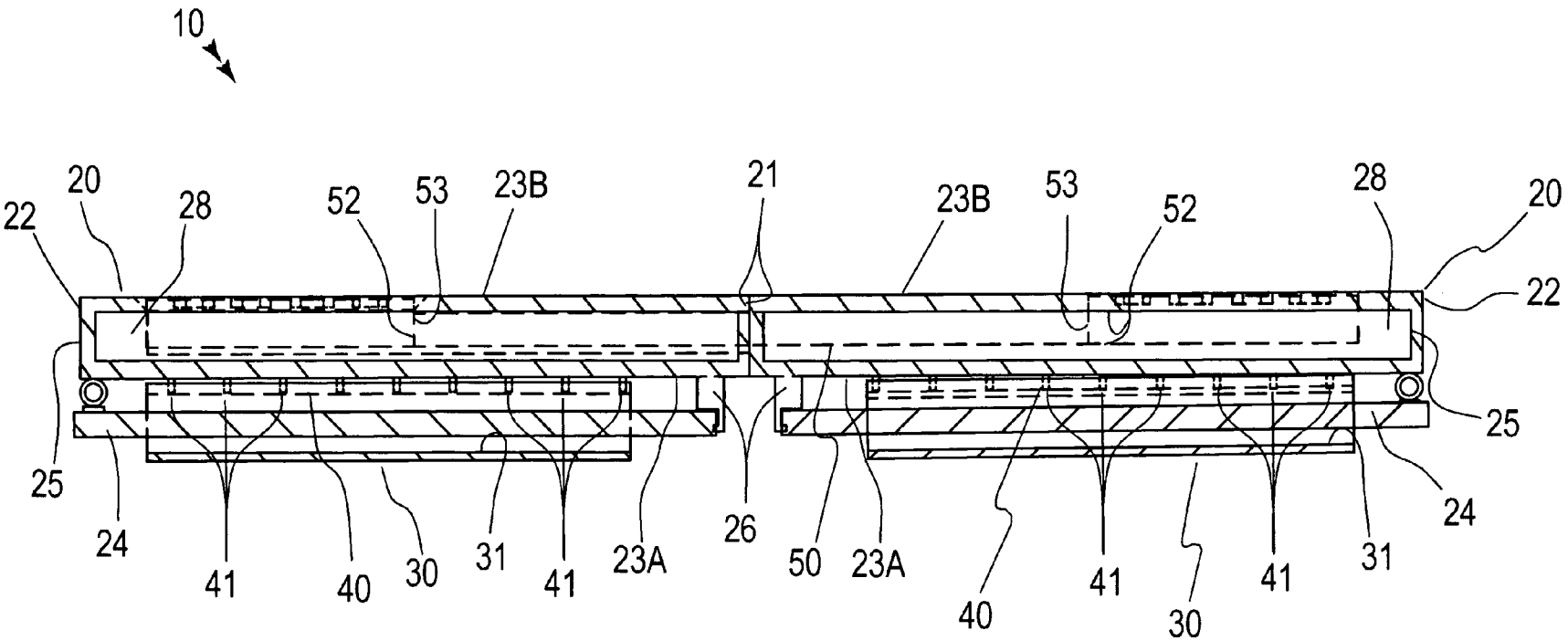
FIG. 5 is a cross-sectional view of the assembly shown in FIG. 1, taken along line 5-5.

The assembly of this invention is referred to generally in FIGS. 1-5 by the reference numeral 10 and is intended to provide a child-proof lock assembly. It should be understood that the assembly 10 may be used to lock many different types of harnesses and should not be limited in use to only the restraining harnesses of infant and toddler car seats.

Referring initially to FIGS. 1 through 5, the assembly 10 includes first and second locks 20 removably attached directly to each other. Such first and second locks 20 are coextensively shaped. The first and second locks 20 are also independently and simultaneously pivotal between folded and unfolded positions, which is critical for allowing each of lock 20 to be independently operated. Each of the first and second locks 20 has a linear medial edge 21 directly conjoined, without the use of intervening elements, to each other when the first and second locks 20 are coupled at a locked position.

Still referring to FIGS. 1 through 5, each first and second lock 20 includes a base section 22 that has planar top 23A and bottom 23B surfaces. A top flap 24 is pivotally connected directly, without the use of intervening elements, to a laterally disposed edge 25 of the base section 22 such that the top flap 24 effectively articulates along a fulcrum axis registered parallel to the longitudinal length of the first and second harnesses 30 (described herein below). Each base section 22 further includes a clasp 26 that is essential for effectively receiving the lateral edge 25 of each of the top flaps 24 so that the top flaps 24 and the base sections 22 remain at the folded position during locked modes.

Again referring to FIGS. 1 through 5, first and second harnesses 30 traverse through the first and second locks 20 such that the first and second harnesses 30 effectively remain spaced apart when the first and second locks 20 are attached to each other. Such first and second harnesses 30 are slidably positioned through the first and second locks 20, which is important and advantageous for allowing a user to adjust the harnesses 30 to accommodate an infant or toddler as they grow and increase in size. It is noted, an advantage of the present invention is to prohibit the locks 20 from sliding along the harnesses 30 during driving conditions. But, it is equally as important for the caregiver to slide the locks 20 along the harnesses 30 during non-driving conditions. The first and second harnesses 30 are intercalated between the base sections 22 and the top flaps 24 respectively, which is critical for ensuring the locks 20 do not slide along the harnesses 30 while the child is seated in a car seat.

Referring to FIGS. 2 through 5, each of the first and second locks 20 includes a mechanism 40 for statically holding the first and second harnesses 30 at a locked position, which is vital such that the first and second harnesses 30 are advantageously and effectively prohibited from sliding through the first and second locks 20 after the first and second locks 20 have been attached to each other. This is an important feature for preventing a fussy child's movements from causing the harnesses 30 slip off of their shoulders, enabling them to climb or fall out of the car seat (not shown) at inopportune times. Such a first and second harness holding mechanism 40 includes a plurality of coextensively shaped rigid pins 41 that are equidistantly spaced along opposed edges 27 of each of the base sections 22 respectively, which is critical for ensuring the locks 20 do not slide along the harnesses 30. The pins 41 extend upwardly from the top surfaces 23A of the base sections 22 and are oriented orthogonal thereto. Each first and second harness 30 has flexible faces 31 directly mateable, without the use of intervening elements, with associated ones of the pins 41, which is crucial such that the pins 41 firmly engage the first and second harnesses 30 when the first and second locks 20 are pivoted to a folded position.

Referring to FIGS. 1 through 5, each of the first and second locks 20 further includes a mechanism 50 for releasably coupling the first and second locks 20 directly to each other such that the first and second locks 20 must be slidably adapted along a linear path defined orthogonal to the first and second harnesses 30 respectively, which is critical for ensuring the locks 20 do not slide along the harnesses 30. Such a releasably coupling mechanism 50 includes a pair of rectilinear arms 51 that protrude outwardly from the linear medial edges 21 of each of the base sections 22 respectively. Each of the rectilinear arms 51 has a flanged distal end 52 provided with a laterally offset shoulder 53.

Again referring to FIGS. 1 through 5, each base section 22 includes a plurality of cavities 28 formed in the linear medial edges 21 thereof and each further includes a plurality of window openings 29 formed in the bottom surfaces 23B respectively. The arms 51 are telescopically inserted through the cavities 28 and along a linear path defined orthogonal to the longitudinal lengths of the first and second harnesses 30 wherein the flanged distal ends 52 of the arms 51 become seated within the window openings 29 when the first and second locks 20 are fully engaged to the locked position. The flanged distal ends 52 of the arms 51 are be visible from the bottom surface 23B of the base sections 22 and are resiliently adaptable towards the top surfaces 23A of the base sections 22 respectively, which is important for effectively releasing the arms 51 from the cavities 28 and thereby unlocking the first and second locks 20. The top flaps 24 are pivotal to an unfolded position while the arms 51 are nested within the cavities 28, which is a crucial feature for allowing a parent to adjust one or both of the first and second harnesses 30 while the first and second locks 20 remain engaged with each other.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A combined child-proof lock and harness assembly for a child vehicle car seat, said lock and harness assembly comprising:

first and second locks removably attached directly to each other;

first and second harnesses traversed through said first and second locks such that said first and second harnesses remain spaced apart when said first and second locks are attached to each other, wherein said first and second harnesses are slidably positioned through said first and second locks;

wherein each of said first and second locks comprises means for statically holding said first and second harnesses at a locked position such that said first and second harnesses are prohibited from sliding through said first and second locks after said first and second locks have been attached to each other, and means for releasably coupling said first and second locks directly to each other such that said first and second locks must be slidably adapted along a linear path defined orthogonal to said first and second harnesses respectively;

wherein each of said first and second locks have a linear medial edge directly conjoined to each other when said first and second locks are coupled at a locked position.

2. The assembly of claim 1, wherein each of said first and second locks further comprises:

a base section having planar top and bottom surfaces; and a top flap pivotally connected directly to a laterally disposed edge of said base section such that said top flap articulates along a fulcrum axis disposed registered parallel to the longitudinal length of said first and second harnesses;

wherein said first and second harnesses are intercalated between said base sections and said top flaps respectively.

3. The assembly of claim 1, wherein said first and second harness holding means comprises:

a plurality of coextensively shaped rigid pins equidistantly spaced along opposed edges of each of said base sections respectively, said pins extending upwardly from said top surfaces of said base sections and being oriented orthogonal thereto, each of said first and second harnesses having flexible faces directly mateable with associated ones of said pins such that said pins firmly engage said first and second harnesses when said first and second locks are pivoted to a folded position.

4. The assembly of claim 1, wherein said releasably coupling means comprises:

a pair of rectilinear arms protruding outwardly from said linear medial edges of each of said base sections respectively, each of said rectilinear arms having a flanged distal end provided with a laterally offset shoulder;

wherein each of said base sections includes a plurality of cavities formed in said linear medial edges thereof, each of said base sections further includes a plurality of window openings formed in said bottom surfaces respectively, said arms being telescopically inserted through said cavities and along a linear path defined orthogonal to the longitudinal lengths of said first and second harnesses wherein said flanged distal ends of said arms become seated within said window openings when said first and second locks are fully engaged to the locked position.

5. The assembly of claim 4, wherein said flanged distal ends of said arms are visible from said bottom surface of said base sections and are resiliently adaptable towards said top surfaces of said base sections respectively for releasing said arms from said cavities and thereby unlocking said first and second locks, wherein said top flaps are pivotal to an unfolded position while said arms are nested within said cavities.

6. The assembly of claim 2, wherein each of said base sections further includes a clasp for receiving said lateral edge of each of said top flaps so that said top flaps and said base sections remain at the folded position during locked modes.

7. A combined child-proof lock and harness assembly for a child vehicle car seat, said lock and harness assembly comprising:

first and second locks removably attached directly to each other, wherein said first and second locks are coextensively shaped;

first and second harnesses traversed through said first and second locks such that said first and second harnesses remain spaced apart when said first and second locks are attached to each other, wherein said first and second harnesses are slidably positioned through said first and second locks;

wherein each of said first and second locks comprises means for statically holding said first and second harnesses at a locked position such that said first and second harnesses are prohibited from sliding through said first and second locks after said first and second locks have been attached to each other, and means for releasably coupling said first and second locks directly to each other such that said first and second locks must be slidably adapted along a linear path defined orthogonal to said first and second harnesses respectively;

wherein each of said first and second locks have a linear medial edge directly conjoined to each other when said first and second locks are coupled at a locked position.

8. The assembly of claim 7, wherein each of said first and second locks further comprises:

a base section having planar top and bottom surfaces; and a top flap pivotally connected directly to a laterally disposed edge of said base section such that said top flap articulates along a fulcrum axis disposed registered parallel to the longitudinal length of said first and second harnesses;

wherein said first and second harnesses are intercalated between said base sections and said top flaps respectively.

9. The assembly of claim 7, wherein said first and second harness holding means comprises:

a plurality of coextensively shaped rigid pins equidistantly spaced along opposed edges of each of said base sections respectively, said pins extending upwardly from said top surfaces of said base sections and being oriented orthogonal thereto, each of said first and second harnesses having flexible faces directly mateable with associated ones of said pins such that said pins firmly engage said first and second harnesses when said first and second locks are pivoted to a folded position.

10. The assembly of claim 7, wherein said releasably coupling means comprises:

a pair of rectilinear arms protruding outwardly from said linear medial edges of each of said base sections respectively, each of said rectilinear arms having a flanged distal end provided with a laterally offset shoulder;

wherein each of said base sections includes a plurality of cavities formed in said linear medial edges thereof, each of said base sections further includes a plurality of window openings formed in said bottom surfaces respectively, said arms being telescopically inserted through said cavities and along a linear path defined orthogonal to the longitudinal lengths of said first and second harnesses wherein said flanged distal ends of said arms become seated within said window openings when said first and second locks are fully engaged to the locked position.

11. The assembly of claim 10, wherein said flanged distal ends of said arms are visible from said bottom surface of said base sections and are resiliently adaptable towards said top surfaces of said base sections respectively for releasing said arms from said cavities and thereby unlocking said first and second locks, wherein said top flaps are pivotal to an unfolded position while said arms are nested within said cavities.

12. The assembly of claim 8, wherein each of said base sections further includes a clasp for receiving said lateral edge of each of said top flaps so that said top flaps and said base sections remain at the folded position during locked modes.

13. A combined child-proof lock and harness assembly for a child vehicle car seat, said lock and harness assembly comprising:

first and second locks removably attached directly to each other, wherein said first and second locks are coextensively shaped, wherein said first and second locks are independently and simultaneously pivotal between folded and unfolded positions;

first and second harnesses traversed through said first and second locks such that said first and second harnesses remain spaced apart when said first and second locks are attached to each other, wherein said first and second harnesses are slidably positioned through said first and second locks;

wherein each of said first and second locks comprises means for statically holding said first and second harnesses at a locked position such that said first and second harnesses are prohibited from sliding through said first and second locks after said first and second locks have been attached to each other, and means for releasably coupling said first and second locks directly to each other such that said first and second locks must be slidably adapted along a linear path defined orthogonal to said first and second harnesses respectively;

wherein each of said first and second locks have a linear medial edge directly conjoined to each other when said first and second locks are coupled at a locked position.

14. The assembly of claim 13, wherein each of said first and second locks further comprises:

a base section having planar top and bottom surfaces; and a top flap pivotally connected directly to a laterally disposed edge of said base section such that said top flap articulates along a fulcrum axis disposed registered parallel to the longitudinal length of said first and second harnesses;

wherein said first and second harnesses are intercalated between said base sections and said top flaps respectively.

15. The assembly of claim 13, wherein said first and second harness holding means comprises:

a plurality of coextensively shaped rigid pins equidistantly spaced along opposed edges of each of said base sections respectively, said pins extending upwardly from said top surfaces of said base sections and being oriented orthogonal thereto, each of said first and second harnesses having flexible faces directly mateable with associated ones of said pins such that said pins firmly engage said first and second harnesses when said first and second locks are pivoted to a folded position.

16. The assembly of claim 13, wherein said releasably coupling means comprises:

a pair of rectilinear arms protruding outwardly from said linear medial edges of each of said base sections respectively, each of said rectilinear arms having a flanged distal end provided with a laterally offset shoulder;

wherein each of said base sections includes a plurality of cavities formed in said linear medial edges thereof, each of said base sections further includes a plurality of window openings formed in said bottom surfaces respectively, said arms being telescopically inserted through said cavities and along a linear path defined orthogonal to the longitudinal lengths of said first and second harnesses wherein said flanged distal ends of said arms become seated within said window openings when said first and second locks are fully engaged to the locked position.

17. The assembly of claim 16, wherein said flanged distal ends of said arms are visible from said bottom surface of said base sections and are resiliently adaptable towards said top surfaces of said base sections respectively for releasing said arms from said cavities and thereby unlocking said first and second locks, wherein said top flaps are pivotal to an unfolded position while said arms are nested within said cavities.

18. The assembly of claim 14, wherein each of said base sections further includes a clasp for receiving said lateral edge of each of said top flaps so that said top flaps and said base sections remain at the folded position during locked modes.

* * * * *